United States Patent [19]

Hull et al.

[11] Patent Number: 4,954,292

[45] Date of Patent: Sep. 4, 1990

[54] DETERGENT COMPOSITION CONTAINING PVP AND PROCESS OF USING SAME

[75] Inventors: Michael Hull, Helsby; Reginald V. Scowen, Wirral, both of United Kingdom

[73] Assignee: Lever Brothers Co., New York, N.Y.

[21] Appl. No.: 97,009

[22] Filed: Sep. 14, 1987

[30] Foreign Application Priority Data

Oct. 1, 1986 [GB] United Kingdom ..... 8623586
Oct. 20, 1986 [GB] United Kingdom ..... 8625102

[51] Int. Cl.[5] ..... C11D 1/83; C11D 3/28; C11D 3/37

[52] U.S. Cl. ..... 252/542; 252/174.23; 252/174.21; 252/524; 252/529; 252/548; 252/DIG. 2; 252/DIG. 15

[58] Field of Search ..... 252/174.23, 174.21, 252/174.22, 542, 548, DIG. 2, DIG. 15

[56] References Cited

U.S. PATENT DOCUMENTS

| | | | |
|---|---|---|---|
| 3,000,830 | 9/1961 | Fong et al. | 252/117 |
| 3,318,816 | 5/1967 | Trowbridge | 252/137 |
| 3,689,435 | 9/1972 | Berni | 252/524 |
| 3,771,951 | 11/1973 | Berni et al. | 8/137 |
| 3,920,561 | 11/1975 | DesMarais | 252/8.8 |
| 3,979,339 | 9/1976 | Claybaugh | 252/524 |
| 4,006,092 | 2/1977 | Jones | 252/95 |
| 4,298,490 | 11/1981 | Lange | 252/91 |
| 4,309,316 | 1/1982 | Lange et al. | 252/543 |
| 4,368,146 | 1/1983 | Aronson | 252/542 |
| 4,529,535 | 7/1985 | Sherman | 252/106 |
| 4,569,782 | 2/1986 | Disch | 252/106 |
| 4,690,779 | 9/1987 | Baker | 252/546 |

FOREIGN PATENT DOCUMENTS

| | | |
|---|---|---|
| 0013585 | 7/1980 | European Pat. Off. . |
| 0181205 | 5/1986 | European Pat. Off. . |
| 0213730 | 3/1987 | European Pat. Off. . |
| 1114606 | 10/1961 | Fed. Rep. of Germany . |
| 2165834 | 12/1971 | Fed. Rep. of Germany . |
| 0084397 | 5/1985 | Japan . |
| 0113696 | 5/1986 | Japan . |
| 0127400 | 6/1987 | Japan . |
| 0715149 | 8/1970 | South Africa . |
| 1079388 | 8/1967 | United Kingdom . |
| 1241754 | 8/1971 | United Kingdom . |
| 1333803 | 10/1973 | United Kingdom . |
| 1348212 | 3/1974 | United Kingdom . |
| 1354498 | 5/1974 | United Kingdom . |
| 1444863 | 8/1976 | United Kingdom . |
| 1450234 | 9/1976 | United Kingdom . |
| 1493085 | 11/1977 | United Kingdom . |
| 1536136 | 12/1978 | United Kingdom . |
| 2038353 | 7/1980 | United Kingdom . |
| 2137221 | 10/1984 | United Kingdom . |
| 2132656 | 5/1986 | United Kingdom . |

*Primary Examiner*—Prince E. Willis
*Attorney, Agent, or Firm*—Matthew T. McDonald

[57] ABSTRACT

A detergent composition contains
(i) an anionic detergent active material;
(ii) polyvinyl pyrrolidone; and
(iii) a nonionic material or a mixture of nonionic materials, the nonionic material or its mixture having an HLB of not more than 10.5

The polyvinyl pyrrolidone and the nonionic material are present to reduce redeposition of suspended soil onto fabrics washed with this composition.

5 Claims, No Drawings

DETERGENT COMPOSITION CONTAINING PVP AND PROCESS OF USING SAME

The present invention relates to a detergent composition, in particular it relates to a detergent composition capable of providing improved soil-suspension.

It is known in the art that the efficient washing of soiled fabrics is dependant on at least two factors, namely the removal of soil from the fabrics and soil suspension, i.e. the prevention of redeposition of the suspended soil onto the fabrics.

It has previously been suggested that materials which improve soil suspension should be added to detergent compositions. U.S. Pat. No. 3,000,830 (Fong et al) discloses the addition of polyvinyl pyrrolidone to a detergent composition to improve soil-suspension. U.S. Pat. No. 3,318,816 (Colgate) discloses a detergent composition containing a detergent active material and a mixture of soil-suspending agents of sodium carboxymethylcellulose and polyvinylpyrrolidone.

We have now discovered that a surprising improvement in soil-suspension can be achieved if a mixture of polyvinyl pyrrolidone and a nonionic material, as hereinafter defined, is present in a detergent composition.

Thus, according to the invention there is provided a detergent composition comprising an anionic detergent active material and polyvinyl pyrrolidone characterised in that the composition further comprises a nonionic material or mixture thereof, the nonionic material or its mixture having an HLB of not more than 10.5.

As is disclosed in the art, polyvinyl pyrrolidone is not a single individual compound and may be obtained in almost any degree of polymerisation. The degree of polymerisation is most easily expressed in terms of average molecular weight. In general, suitable soil-suspending vinyl pyrrolidone polymers are soluble in water at least to the extent of 0.001% to 0.1%. Suitable polymers will also be linear in structure and have an average molecular weight within the range of about 5,000 to about 100,000 and preferably from about 15,000 to about 50,000.

The level of the polyvinyl pyrrolidone in the detergent composition is preferably within the range from 0.1% to 1% by weight and most preferably is within the range from about 0.3 to 0.5% by weight.

The compositions contain nonionic materials having an HLB of not more than 10.5, preferably in the range from 6 to 10, most preferably in the range 8 to 9.5. The composition can also contain a mixture of one or more nonionic materials. The mixture can contain one nonionic material having an HLB of more than 10.5 providing the average HLB of the mixture of nonionic materials is not more than 10.5. The HLB scale is a known measure of hydrophilic-lipohillic balance in any compound It is fully defined in the literature, for example in "Nonionic Surfactants" Volume I, edited by M. J. Schick. A method of determining the HLB of a mixture of nonionic materials is also defined in this reference.

Nonionic materials having a lower HLB value are less hydrophilic than those having higher HLB values.

Suitable nonionic compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic compounds are alkyl ($C_6$–$C_{22}$) phenols-ethylene oxide condensates, generally up to 25 EO, ie up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other nonionic materials include long chain tertiary phosphine oxides, dialkyl sulphoxides, $C_8$–$C_{24}$ fatty acids; esters of $C_8$–$C_{24}$ fatty acids with monohydric alcohols containing 1–3 carbon atoms, and $C_{10}$–$C_{18}$ fatty alcohols.

Preferred nonionic materials are the alkoxylate adducts of fatty compounds selected from fatty alcohols, fatty acids, fatty esters, fatty amides and fatty amines. The fatty compound contains at least 10 carbon atoms and the nonionic material contains an average of less than 8 alkylene oxide groups per molecule.

Alkylene oxide adducts of fatty alcohols useful in the present invention, preferably have the general formula:

$$R^{10}—O—(C_nH_{2n}O)_yH$$

wherein $R^{10}$ is an alkyl or alkenyl group having at least 10 carbon atoms, most preferably from 10 to 22 carbon atoms, y is preferably not more than n, such as from about 0.5 to about 3.5 and n is 2 or 3. Examples of such materials include Synperonic A3 (ex ICI) which is a $C_{13}$–$C_{15}$ alcohol with about three ethylene oxide groups per molecule and Empilan KB3 (ex Marchon) which is lauric alcohol 3EO.

Alkylene oxide adducts of fatty acids useful in the present invention, preferably have the general formula $$R^{10}—\underset{\underset{O}{\|}}{C}—O—(C_nH_{2n}O)_yH$$

wherein $R_{10}$, n and y are as given above. Suitable examples include ESONAL 0334 (ex Diamond Shamrock) which is a tallow fatty acid with about 2.4 ethylene oxide groups per molecule.

Alkylene oxide adducts of fatty esters useful in the present invention include adducts of mono-, di- or tri-esters of polyhydric alcohols containing 1 to 4 carbon atoms; such as coconut or tallow oil (triglyceride) 3EO (ex Stearine Dubois).

Alkylene oxide adducts of fatty amides useful in the present invention, preferably have the general formula $$R^{10}—\underset{\underset{O}{\|}}{C}—N\begin{matrix}(C_nH_{2n}O)_xH\\(C_nH_{2n}O)_zH\end{matrix}$$

wherein $R^{10}$ is an alkyl or alkenyl group having at least 10 carbon atoms, most preferably from 10 to 22 carbon atoms, most preferably from 10 to 22 carbon atoms, n is 2 or 3 and x and z in total are not more than 4.0, preferably from about 0.5 to about 3.5 while one of x and z can be zero. Examples of such materials include tallow monoethanolamide and diethanolamide, and the corresponding coconut and soya compounds.

Alkylene oxide adducts of fatty amines useful in the present invention, preferably have the general formula

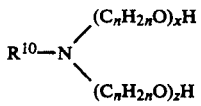

wherein $R^{10}$ and n are as given above, and x and z in total are preferably not more than 4.0, most preferably from about 0.5 to about 3.5. Examples of such materials include Ethomeen T12 (tallow amine 2EO, available from AKZO), Optameen PC5 (coconut alkyl amine 5EO) and Crodamet 1.02 (oleylamine 2EO, available from Croda Chemicals).

The total level of the polyvinyl pyrrolidone and nonionic material in the detergent composition is preferably within the range from about 0.1% to about 5%, most preferably from about 0.3% to about 3% by weight of the composition.

An improvement in soil suspension may be achieved at all mixing ratios of the polyvinyl pyrrolidone material and the nonionic material. Preferably, the ratio of the poly vinyl pyrrolidone to the nonionic material in the detergent composition is within the range from about 8:2 to about 2:8, most preferably from about 6:4 to about 4:6, by weight.

The anionic detergent active material can be a soap or a non-soap (synthetic) anionic material. Anionic detergent active materials are commercially available and are fully described in the literature, for example in "Surface Active Agents and Detergents", Volumes I and II by Schwartz, Perry and Berch.

Synthetic anionic detergent active materials useful in the present invention are water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; sodium and potassium salts of fatty acid ester sulphonates; water-soluble salts of dialkyl esters of sulphosuccinic acid; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Mixtures of anionic compounds may also be used in the detergent compositions.

Amounts of amphoteric or zwitterionic detergent compounds can also be used in the composition of the invention but this is not normally desired due to their relatively high cost. If any amphoteric or zwitterionic detergent compounds are used it is generally in small amounts in compositions based on the much more commonly used anionic detergent compounds.

The effective amount of the detergent active compound or compounds used in the compositions is generally in the range from 5 to 40% by weight, preferably not more than 30% by weight of the composition.

The detergent composition according to the invention may also contain from about 5% to about 90% of a detergency builder, which can be an inorganic builder or an organic builder.

Examples of phosphorus-containing inorganic detergency builders, when present, include the water-soluble salts, especially alkaline metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonates, sodium and potassium bicarbonates and silicates.

Examples of organic detergency builders, when present, include the alkaline metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

The detergent composition according to the invention may also contain any of the conventional additives in the amounts in which such materials are normally employed in fabric washing detergent compositions. Examples of these additives include lather boosters oxygen-releasing bleaching agents such as sodium perborate and sodium percarbonate, peracid bleach precursors, chlorine-releasing bleaching agents, fabric softening agents, inorganic salts, such as sodium sulphate, and usually present in very minor amounts fluorescent agents, perfumes, germicides and colourants.

It is also desirable to include in the detergent compositions according to the invention an amount of an alkali metal silicate, particularly sodium ortho-, meta- or preferably neutral or alkaline silicate. The presence of such alkali metal silicates at levels of at least about 1%, and preferably from about 3% to about 15%, by weight of the composition, is advantageous in decreasing the corrosion of metal parts in washing machines, besides giving processing benefits and generally improved powder properties. The more highly alkaline ortho- and metasilicates would normally only be used at lower amounts within this range, in admixture with the neutral or alkaline silicates.

It is generally also desirable to include a structurant material, such as succinic acid, and/or other dicarboxylic acids, sucrose and polymers, in detergent compositions of the invention, to provide a powder having excellent physical properties.

The detergent composition according to the invention can be manufactured in the form of a powder, liquid paste i.e. having a viscosity significantly in excess of 1000 mPas at a shear rate of $21s^{-1}$ or bar.

Detergent powder compositions according to the invention can be prepared using any of the conventional manufacturing techniques commonly used or proposed for the preparation of fabric washing detergent powder compositions. These include slurry-making followed by spray-drying or spray-cooling and subsequent dry-dosing of sensitive ingredients not suitable for incorporation prior to a drying or heating step. Other conventional techniques, such as noodling, granulation, mixing by fluidisation in a fluidised bed, may be utilised as and when necessary. Such techniques are familiar to those skilled in the art of fabric washing detergent powder composition manufacture.

In use the detergent compositions according to the present invention are particularly suitable for washing synthetic fibre fabrics.

The invention is further illustrated by the following non-limiting examples.

EXAMPLES

Detergent composition A was prepared having the formulation set out below. The mixture of ethoxylated nonionic materials used in this composition had a HLB value of 9.0. Detergent composition A was compared for performance with detergent composition C which contained an ethoxylated nonionic material with an HLB value of 11.8.

| | A | B | C | D |
|---|---|---|---|---|
| DOB 113 | 9.0 | 9.0 | 9.0 | 9.0 |
| Synperonic A7 | 1.0 | 1.0 | 4.0 | 4.0 |
| Synperonic A3 | 3.0 | 3.0 | — | — |
| STP | 23.0 | 23.0 | 23.0 | 23.0 |
| Alkaline silicate | 6.0 | 6.0 | 6.0 | 6.0 |
| Sodium sulphate | 33.0 | 33.0 | 33.0 | 33.0 |
| Sodium carbonate | 5.0 | 5.0 | 5.0 | 5.0 |
| Sodium metaborate | 6.9 | 6.9 | 6.9 | 6.9 |
| Sokalan HP 50 | 0.5 | 0 | 0.5 | 0 |
| Water | balance | balance | balance | balance |

Treatment baths for compositions A, B, C and D were prepared by dissolving the polyvinyl pyrrolidone into a liquor which contained all the other components and which was equivalent to a dosage level of 5g per litre.

Each of the compositions were used to wash a mixture of cloths comprising five pieces of clean cotton interlock, five pieces of clean combined polyester and five pieces of soiled cloth. Each piece of cloth measured 7.5 cm ×7.5 cm. These experiments were carried out in a laboratory apparatus in a litre of 24° FH water at 40° C. The washing process was repeated six times for each composition with the same cotton and polyester cloths but with new soiled cloths.

After washing, the cloths were rinsed and then tumble dried. Using a micromatch reflectance spectrophotometer, fitted with a UV filter, the reflectance of the treated test cloth at 460nm was determined. For comparison purposes reflectance values at 460 nm were measured for untreated polyester and cotton cloths. The value of $\Delta R^*$ is the difference in reflectance between the washed and untreated cloths. Values of $$\frac{K}{S},$$

where K is the absortivity coefficient and S is the scattering coefficient, were also determined for the treated polyester cloth. The quantity $$\frac{K}{S}$$

is proportional to the weight of colouring matter present. The value of $$\frac{K}{S}$$

is derived from the relationship $$\frac{K}{S} = \frac{(1-R)^2}{2R},$$

where R is the reflectance of the cloth at 460 nm in these examples.

EXAMPLES 1 & 2

Cotton and polyester cloths were washed with detergent compositions A, B, C and D and with soiled test cloths according to the method described above. Values of $\Delta R_{460}^*$ were determined and the average over two sets of measurements are given below.

EXAMPLE 1

Reflectance loss data ($-\Delta R_{460}^*$) for polyester cloths

| Wash No | D | B | C | A |
|---|---|---|---|---|
| 1 | 5.1 | 4.2 | 3.0 | 1.8 |
| 2 | 4.8 | 3.8 | 4.3 | 1.9 |
| 3 | 5.2 | 3.7 | 5.9 | 2.1 |
| 4 | 6.4 | 3.6 | 7.2 | 2.2 |
| 5 | 7.5 | 3.8 | 8.6 | 2.7 |
| 6 | 8.7 | 3.6 | 9.9 | 2.7 |

EXAMPLE 2

Reflectance loss data ($-\Delta R_{460}^*$) for cotton cloths.

| Wash No | D | B | C | A |
|---|---|---|---|---|
| 1 | 2.4 | 2.8 | 2.1 | 3.4 |
| 2 | 2.8 | 2.9 | 3.1 | 3.7 |
| 3 | 3.9 | 4.1 | 4.0 | 4.2 |
| 4 | 4.5 | 4.7 | 3.9 | 4.7 |
| 5 | 5.0 | 5.0 | 4.7 | 5.2 |
| 6 | 5.1 | 5.2 | 5.1 | 5.5 |

It is apparent from the results in Example 1 and Example 2 that a detergent composition containing PVP and ethoxylated nonionic materials with an HLB of less than 10.5 give a surprising improvement in soil suspension on polyester cloth.

EXAMPLE 3

Polyester cloths and the soiled test cloths were washed with detergent compositions A, B, C and D according to the method described above. Average values of $\frac{K}{S}$, over two sets of measurements, were determined. Using these results ratios of $\frac{K}{S}$ for cloths washed with detergent compositions in which PVP was absent to those washed with compositions in which PVP was present were determined.

| Wash No | Ratios of Re-deposited Soil $\frac{D}{C}$ | $\frac{B}{A}$ |
|---|---|---|
| 1 | 1.9 | 2.6 |
| 2 | 1.1 | 2.2 |
| 3 | 0.9 | 1.9 |
| 4 | 0.9 | 1.7 |
| 5 | 0.9 | 1.5 |
| 6 | 0.9 | 1.4 |

It is apparent from these results there is a surprising improvement in soil suspension when polyester cloths are washed with a detergent composition containing both PVP and ethoxylated nonionic material with an HLB of less than 10.5.

NOTES

1. DOBS 113 (ex Shell Chemicals) is approximately sodium alkyl benzene sulphonate in which the alkyl group contains 10 to 15 carbon atoms.
2. Synperonic A7 (ex ICI) is an alcohol ethoxylated with an average of 7 ethylene oxide groups per molecule.
3. Synperonic A3 (ex ICI) is an alcohol ethoxylated with with an average of 3 ethylene oxide groups per molecule.
4. Sokalan HP50 (ex BASF) is a vinyl pyrrolidone polymer with an average molecular weight of 40,000.
5. As used herein "° FH" with respect to water hardness is the molar concentration of free hard water ions $\times 10^{-4}$.
6. STP is sodium tripolyphosphate.

We claim:

1. A detergent composition for washing soiled fabrics comprising 5 to 90% by weight of an inorganic detergency builder; 5 to 40% by weight of an anionic detergent active material; polyvinyl pyrrolidone having a molecular weight of from about 5,000 to about 100,000; and an alkoxylated nonionic material or a mixture thereof, wherein the HLB value of the nonionic material or its mixture is not more than 10.5; the ratio of the polyvinyl pyrrolidone to the nonionic material is within the range from 8:2 to 2:8 and the total level of the polyvinyl pyrrolidone and the nonionic material is within the range from 0.1 to 5% by weight.

2. A detergent composition according to claim 1 wherein the molecular weight of the polyvinyl pyrrolidone is within the range from 15,000 to 50,000.

3. A detergent composition according to claim 1 wherein the level of the polyvinyl pyrrolidone is within the range from 0.3 to 0.5% by weight

4. A detergent composition according to claim 1 wherein the nonionic material is an alkoxylate adduct of a fatty compound selected from fatty alcohols, fatty acids, fatty esters, fatty amines and fatty amides, the fatty compound containing at least 10 carbon atoms and the adduct containing an average of less than 8 alkylene oxide groups per molecule.

5. A process for removing soil from fabric and reducing the redeposition of removed soil comprising washing the fabrics with a detergent composition according to claim 1.

* * * * *